US011499569B2

(12) United States Patent
Joly et al.

(10) Patent No.: US 11,499,569 B2
(45) Date of Patent: Nov. 15, 2022

(54) MIXED-FLOW COMPRESSOR WITH COUNTER-ROTATING DIFFUSER

(71) Applicant: Carrier Corporation, Palm Beach Gardens, FL (US)

(72) Inventors: Michael M. Joly, Hebron, CT (US); Chaitanya Vishwajit Halbe, Manchester, CT (US); William T. Cousins, Glastonbury, CT (US); Vishnu M. Sishtla, Mailus, NY (US)

(73) Assignee: CARRIER CORPORATION

( * ) Notice: Subject to any disclaimer, the term of this patent is extended or adjusted under 35 U.S.C. 154(b) by 11 days.

(21) Appl. No.: 17/254,328

(22) PCT Filed: Jun. 16, 2020

(86) PCT No.: PCT/US2020/037850
§ 371 (c)(1),
(2) Date: Dec. 21, 2020

(87) PCT Pub. No.: WO2020/263614
PCT Pub. Date: Dec. 30, 2020

(65) Prior Publication Data

US 2022/0049717 A1 Feb. 17, 2022

Related U.S. Application Data

(60) Provisional application No. 62/868,480, filed on Jun. 28, 2019.

(51) Int. Cl.
*F04D 29/44* (2006.01)
*F04D 17/02* (2006.01)
(Continued)

(52) U.S. Cl.
CPC ..... *F04D 29/442* (2013.01); *F04D 17/025* (2013.01); *F04D 17/127* (2013.01); *F04D 29/284* (2013.01); *F04D 29/503* (2013.01)

(58) Field of Classification Search
CPC ..... F04D 17/10; F04D 17/122; F04D 17/127; F04D 17/025; F04D 29/44; F04D 29/442; F04D 29/447
See application file for complete search history.

(56) References Cited

U.S. PATENT DOCUMENTS 2,648,493 A * 8/1953 Stalker ..... F04D 21/00 415/181
5,152,661 A * 10/1992 Sheets ..... F04D 29/544 415/208.4
(Continued)

FOREIGN PATENT DOCUMENTS

CN 10798804 5/2018
EP 2206928 7/2010
(Continued)

OTHER PUBLICATIONS

International Search Report and Written Opinion for International Application No. PCT/US2020/037850 dated Jun. 16, 2020.
(Continued)

*Primary Examiner* — Topaz L. Elliott
*Assistant Examiner* — Jackson N Gillenwaters
(74) *Attorney, Agent, or Firm* — Carlson, Gaskey & Olds, P.C.

(57) ABSTRACT

A compressor includes a housing. An impeller is located within the housing and rotatable about an impeller axis in a first rotational direction. A rotor section is rotatable about the impeller axis in a second rotational direction opposite the first rotational direction.

18 Claims, 3 Drawing Sheets

(51) Int. Cl.

| | |
|---|---|
| ***F04D 17/12*** | (2006.01) |
| ***F04D 29/28*** | (2006.01) |
| ***F04D 29/50*** | (2006.01) |

(56) References Cited

U.S. PATENT DOCUMENTS

| | | | | |
|---|---|---|---|---|
| 2003/0210980 | A1 | 11/2003 | Lawlor et al. | |
| 2004/0076513 | A1* | 4/2004 | Sishtla | F04D 29/462 415/150 |
| 2010/0158665 | A1* | 6/2010 | Hofer | F04D 19/024 415/66 |
| 2017/0074280 | A1 | 3/2017 | Vo | |

FOREIGN PATENT DOCUMENTS

| | | | | |
|---|---|---|---|---|
| GB | 666761 | | 2/1952 | |
| JP | 2005299573 | | 10/2005 | |
| WO | 2013141912 | | 9/2013 | |
| WO | WO-2013141912 | A2 * | 9/2013 | F04D 17/025 |

OTHER PUBLICATIONS

International Preliminary Report on Patentability for International Application No. PCT/US2020/037850 dated Jan. 6, 2022.

* cited by examiner

MIXED-FLOW COMPRESSOR WITH COUNTER-ROTATING DIFFUSER

CROSS-REFERENCE TO RELATED APPLICATIONS

This application claims priority to U.S. Provisional Application No. 62/868,480, which was filed on Jun. 28, 2019 and is incorporated herein by reference.

BACKGROUND

The disclosure herein relates generally to an example mixed-flow compressor, and more particularly, to a diffuser structure for use in a mixed-flow compressor of a refrigeration system.

Existing mixed-flow compressors typically include a power driven impeller through which an inflow of refrigerant is induced that is turned radially outward and then back to axial flow into a diffuser. A diffuser of the compressor commonly includes an annular passage defined by a wall surface of a fixed plate radially spaced from a shaped wall surface of a shroud, and a set of vanes. The diffuser has an inlet end receiving the impeller outflow and an outlet end from which refrigerant is provided to a compressor volute that is circumferentially divergent for example. Kinetic energy is converted by the diffuser of the compressor into a static pressure rise within the diffuser.

SUMMARY

In one exemplary embodiment, a compressor includes a housing. An impeller is located within the housing and rotatable about an impeller axis in a first rotational direction. A rotor section is rotatable about the impeller axis in a second rotational direction opposite the first rotational direction.

In a further embodiment of the above, the rotor section includes a rotor that has at least one row of rotor blades.

In a further embodiment of any of the above, the impeller includes a hub and a plurality of impeller blades that extend outward from the hub toward a portion of the housing.

In a further embodiment of any of the above, the rotor section includes a cylindrical rotor with a plurality of rotor blades that extend from a surface of the cylindrical rotor.

In a further embodiment of any of the above, the plurality of impeller blades each include an upstream end and downstream end with the upstream end being circumferentially spaced in the first rotational direction from the downstream end. The plurality of rotor blades each include an upstream end and a downstream end with the upstream end being circumferentially spaced in the second rotational direction from the downstream end.

In a further embodiment of any of the above, each of the plurality of rotor blades and each of the plurality of impeller blades include a curvature in the first circumferential direction.

In a further embodiment of any of the above, the impeller is driven by an impeller motor and the rotor is driven by a separate rotor motor.

In a further embodiment of any of the above, the impeller is driven by an impeller motor and the rotor section is driven by the impeller motor through a transmission to reverse a rotational output of the impeller motor.

In a further embodiment of any of the above, the transmission is a variable ratio transmission.

In a further embodiment of any of the above, an outlet of the impeller is immediately upstream of an inlet to the rotor section.

In a further embodiment of any of the above, the compressor is a mixed flow compressor.

In a further embodiment of any of the above, the compressor is operable with a low pressure refrigerant or a medium pressure refrigerant.

In another exemplary embodiment, a method of operating a compressor includes the steps of rotating an impeller in a first rotational direction with an impeller motor to draw refrigerant into an inlet of the compressor. A rotor section is rotated downstream of the impeller in a second rotational direction opposite the first rotational direction. The refrigerant is directed from the rotor section to a compressor outlet.

In a further embodiment of any of the above, the method includes turning a direction of the refrigerant in an axial direction with the rotor section.

In a further embodiment of any of the above, the method includes driving the impeller with an impeller motor and driving the rotor section with a rotor section motor.

In a further embodiment of any of the above, the method includes driving the impeller with an impeller motor and driving the rotor section with the impeller motor through a transmission.

In a further embodiment of any of the above, the method includes varying a magnitude or rotation from an output of the impeller motor with the transmission.

In a further embodiment of any of the above, the method includes reversing a direction of rotation of an output of the impeller motor with the transmission.

In a further embodiment of any of the above, the compressor is a mixed flow compressor.

In a further embodiment of any of the above, the compressor is operable with a low pressure refrigerant or a medium pressure refrigerant.

DETAILED DESCRIPTION

Figure 1:
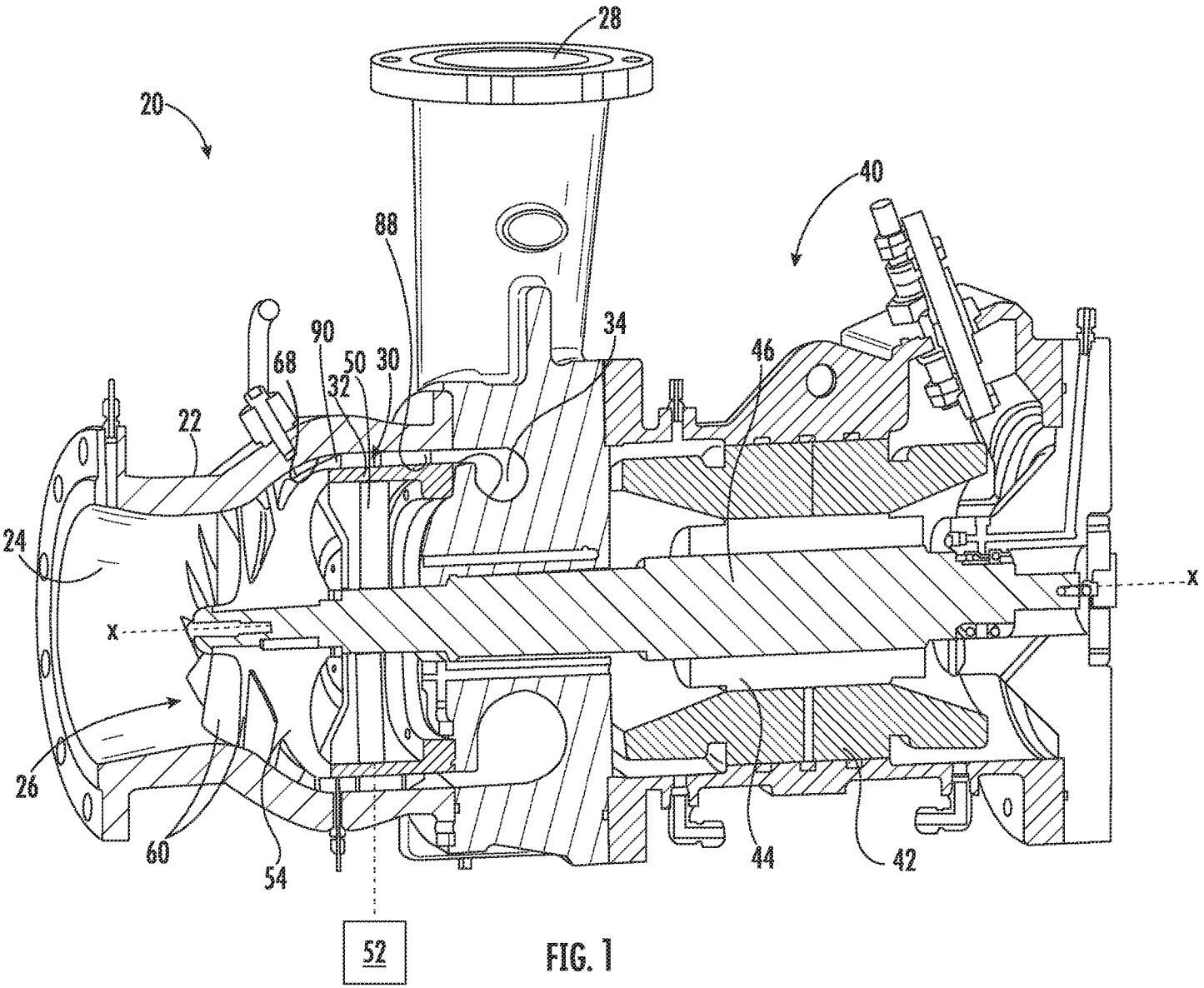
FIG. 1 is a perspective cross-sectional view of a mixed-flow compressor according to a non-limiting example.

Mixed-flow compressors are used in a number of applications, such as in a refrigeration system to move a refrigerant through a refrigeration circuit. FIG. 1 illustrates an example "mixed flow" compressor 20 used to compress and transfer refrigerant in the refrigeration system. In order to transfer and compress a refrigerant, the compressor 20 is capable of operating with refrigerants at a low or medium pressure.

In the illustrated example shown in FIG. 1, the compressor 20 includes a main casing or housing 22 that at least partially defines an inlet 24 into the compressor 20 for receiving refrigerant and an outlet 28 for discharging the refrigerant from the compressor 20. The compressor 20 draws the refrigerant towards the inlet 24 by rotating an impeller 26 immediately downstream of the inlet 24. The impeller 26 then directs the refrigerant to a rotor section 30 located axially downstream of the impeller 26. The rotor section 30 includes a rotor 32 that rotates in an opposite rotational direction from the impeller 26. From the rotor section 30, the refrigerant travels in an axial direction downstream and enters a volute 34 before being redirected from the axial direction to a radial direction outward toward the outlet 28 of the compressor 20.

The compressor 20 also includes a motor section 40 for driving the impeller 26 and/or the rotor 32 in the rotor section 30. In the illustrated example, the motor section 40 includes a stator 42 attached to a portion of the housing 22 that surrounds a rotor 44 attached to an impeller drive shaft 46. The impeller drive shaft 46 is configured to rotate about an axis X. The axis X of rotation is common with the impeller 26, the rotor section 30, the rotor 44, and the impeller drive shaft 46 and is common with a central longitudinal axis extending through the housing 22. In this disclosure, axial or axially and radial or radially is in relation to the axis X unless stated otherwise.

In one example, the rotor 32 in the rotor section 30 is driven by the motor section 40 through a transmission 50 in engagement with the drive shaft 46. The transmission 50 receives an input driving force from the drive shaft 46 rotating in a first rotational direction and reversed the input from the drive shaft 46 to create an output that rotates the rotor 32 in a second rotational direction opposite from the first rotational direction. Furthermore, the transmission 50 can be a variable ratio transmission such that a magnitude of the rotation in the first rotational direction can be increased or decreased in relation to a magnitude of the rotation in the second rotational direction. Alternatively, the rotor 32 in the rotor section 30 could be driven by a rotor drive motor 52 in engagement with the rotor 32. The engagement of the rotor drive motor 52 with the rotor 32 is schematically illustrated in FIG. 1.

Figure 2A:
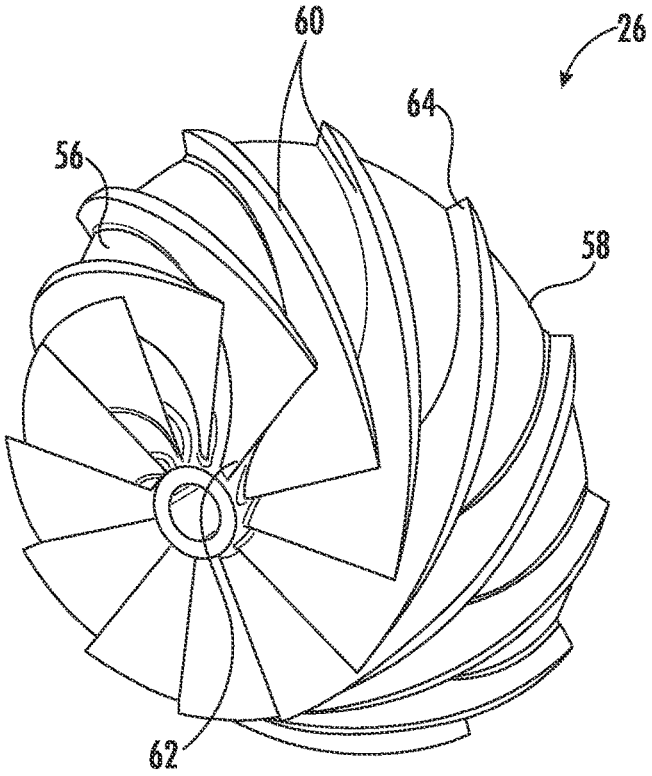
FIG. 2A is front perspective view of an impeller of the mixed-flow compressor of FIG. 1.
Figure 2B:
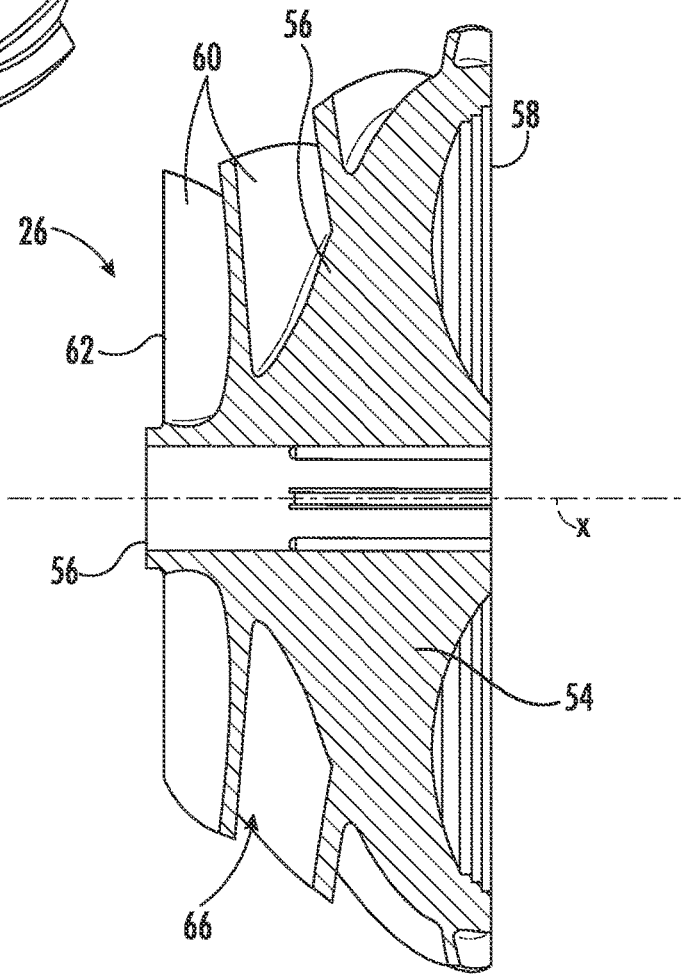
FIG. 2B is a cross-sectional view of the impeller of FIG. 2A.

As shown in FIGS. 2A and 2B, the impeller 26 includes a hub or body 54 having a front side 56 and back side 58. As shown, the diameter of the front side 56 of the body 54 generally increases toward the back side 58, such that the impeller 26 is generally conical in shape. A plurality of blades 60 extend radially outward from the body 54 relative to the axis X. Each of the plurality of blades 60 is arranged at an angle to the axis of rotation X of the drive shaft 46. In one example, each of the blades 60 extends between the front side 56 and the back side 58 of the impeller 26. As shown, each of the blades 60 includes an upstream end 62 adjacent the front side 56 and a downstream end 64 adjacent the back side 58. Further, the downstream end 64 of the blade 60 is circumferentially offset from the corresponding upstream end 62 of the blade 60.

A plurality of passages 66 is defined between adjacent blades 60 to discharge a fluid passing over the impeller 26 generally parallel to the axis X. As the impeller 26 rotates, fluid approaches the front side 56 of the impeller 26 in a substantially axial direction and flows through the passages 66 defined between adjacent blades 60. Because the passages 66 have both an axial and radial component, the axial flow provided to the front side 56 of the impeller 26 simultaneously moves both parallel to and circumferentially about the axis X of the drive shaft 46. In combination, an inner surface 68 (shown in FIG. 1) of the housing 22 and the passages 66 of the impeller 26 cooperate to discharge the compressed refrigerant from the impeller 26 to the rotor section 30. In one example, the compressed refrigerant is discharged from the impeller 26 at an angle relative to the axis X of the drive shaft 46 into the adjacent rotor section 30.

Figure 3A:
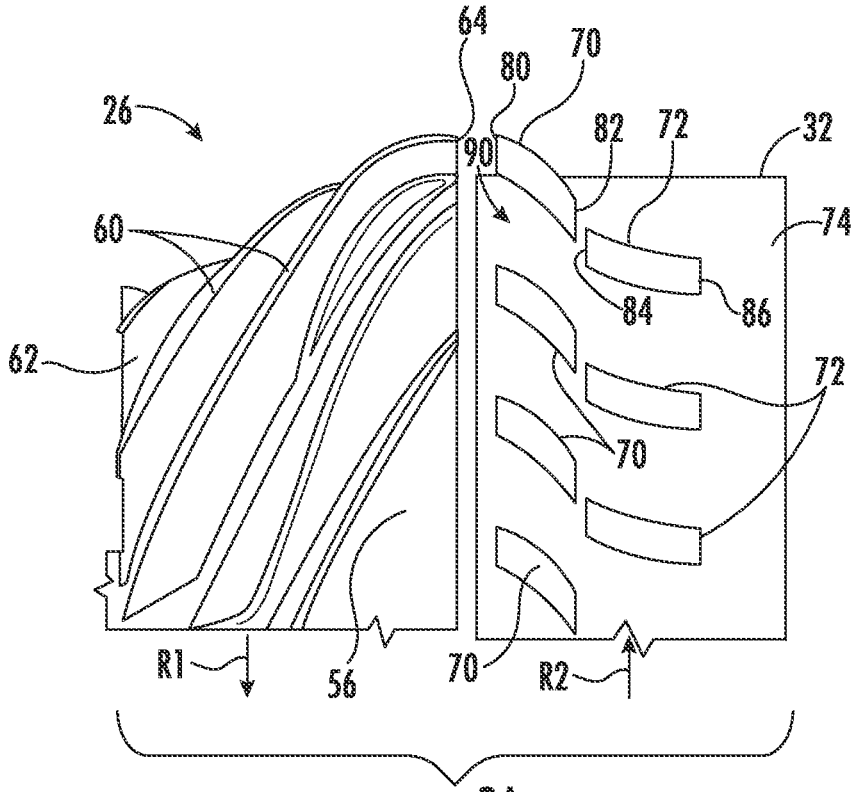
FIG. 3A illustrates an example rotor in a rotor section of the mixed-flow compressor of FIG. 1.

FIG. 3A schematically illustrates the impeller 26 positioned relative to the rotor 32. In the illustrated example, the rotor 32 includes a first row of blades 70 located axially upstream from a second row of blades 72. The first and second rows of rotor blades 70, 72 extend radially outward from a body portion 74 of the rotor 32. The body portion 74 includes a generally tubular or cylindrical shape. Alternatively, the first and second rows of rotor blades 70, 72 could extend radially inward from the body portion 74.

The rotor 32 forms fluid passages 90 between adjacent blades in the first and second rows of blades 70, 72 in cooperation with the body portion 74 and an inner surface 88 of the housing 22. The inner surface 88 is located axially downstream from the inner surface 68. The inner surface 88 extends in an axial direction with a generally constant radial dimension such that the fluid passage 90 also extends in an axial direction to the volute 34.

FIG. 3A also illustrates the upstream ends 62 of the blades 60 being spaced in a first rotational direction R1 from a corresponding one of the downstream ends 64 of the blades 60. Additionally, the blades 60 can include a curvature in the first rotational direction R1 or the blades 60 can be straight between the upstream end 62 and the downstream end 64.

Each of the blades in the first row of blades 70 includes an upstream end 80 that is circumferentially spaced in a second rotational direction R2 from a downstream end 82. The first row of blades 70 can be straight or include a curvature that extends in the first rotational direction. Similarly, each of the blades in the second row of blades 72 includes an upstream end 84 circumferentially spaced in the second rotational direction R2 from a downstream end 86. Also, the second row of blades 72 includes a curvature that extends in the first rotational direction R1. Furthermore, in the illustrated example, the curvature of the second row of blades 72 is a larger curvature than the first row of blades 70.

Figure 3B:
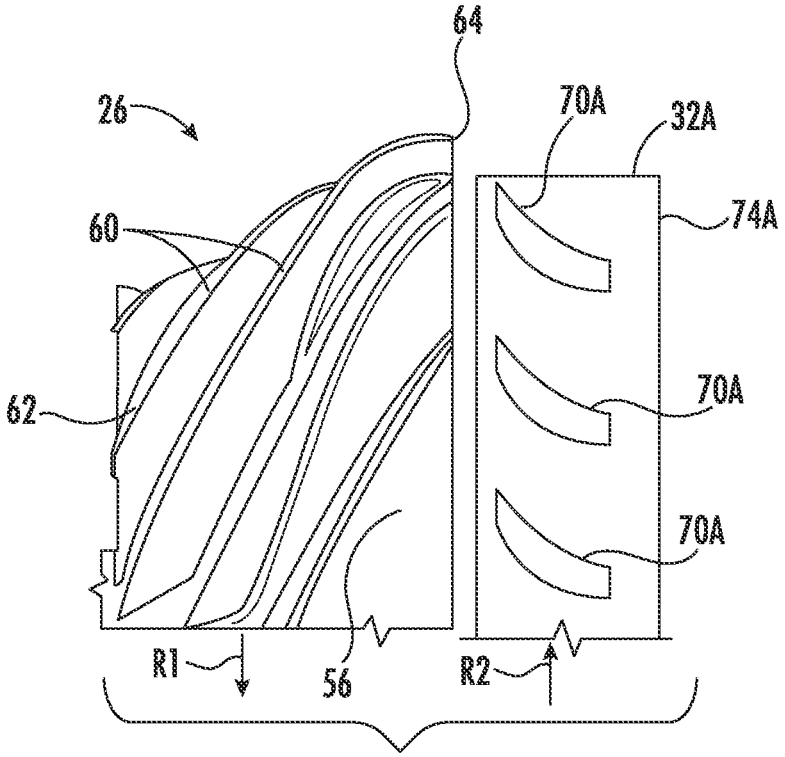
FIG. 3B illustrates another example rotor of the rotor section of the mixed-flow compressor of FIG. 1.

FIG. 3B illustrates another example rotor 32A located immediately downstream from the impeller 26 similar to the rotor 32 except where described below or shown in the Figures. The rotor 32A only includes a single row of blades 70A. Each of the blades in the single row of blades 70A includes an upstream end 80A circumferentially spaced in a second rotational direction R2 from a downstream end 82A. Also, the first row of blades 70A includes a curvature that extends in the first rotational direction.

During operation of the compressor 20, the impeller 26 rotates in the first rotational direction R1 and the rotor 32, 32A rotates in the second rotation direction R2 which is opposite from the first rotational direction R1. The rotor 32, 32A also turns the refrigerant in an axial direction. The rotor 32, 32A can rotate with the same magnitude but in an opposite rotational direction from the impeller 26 through the use of the transmission 50 between the rotor 32, 32A and the drive shaft 46. Alternatively, the transmission 50 can vary the magnitude of rotation of the rotor 32, 32A compared to the impeller 26 based on a desired operating condition of the compressor 20. Furthermore, the rotor 32, 32A can be driven separately from the impeller 26 with the use of the rotor drive motor 52 schematically illustrated in FIG. 1.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary examples, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A compressor comprising:

a housing;

an impeller located within the housing and rotatable about an impeller axis in a first rotational direction; and a rotor section rotatable about the impeller axis in a second rotational direction opposite the first rotational direction, wherein the rotor section includes a rotor having a plurality of rotor blades forming at least one row of rotor blades and an outlet of the impeller is immediately upstream of an inlet to the at least one row of rotor blades and the at least one row of blades includes an upstream row of blades having a curvature in the second rotational direction and a downstream row of blades having a curvature in the first rotational direction.

2. The compressor of claim 1, wherein the impeller includes a hub and a plurality of impeller blades extending outward from the hub toward a portion of the housing and the impeller is driven by an impeller motor.

3. The compressor of claim 2, wherein the rotor section includes a cylindrical rotor with a plurality of rotor blades extending from a radially outer surface of the cylindrical rotor.

4. The compressor of claim 3, wherein the plurality of impeller blades each include an upstream end and downstream end with the upstream end being circumferentially spaced in the first rotational direction from the downstream end and the plurality of rotor blades each include an upstream end and a downstream end with the upstream end being circumferentially spaced in the second rotational direction from the downstream end.

5. The compressor of claim 4, wherein each of the plurality of rotor blades and each of the plurality of impeller blades include a curvature in a first circumferential direction.

6. The compressor of claim 1, wherein the impeller is driven by an impeller motor and the rotor is driven by a separate rotor motor.

7. The compressor of claim 1, wherein the impeller is driven by an impeller motor and the rotor section is driven by the impeller motor through a transmission to reverse a rotational output of the impeller motor.

8. The compressor of claim 7, wherein the transmission is a variable ratio transmission.

9. The compressor of claim 1, wherein the compressor is a mixed flow compressor, an axial gap separates the impeller from the rotor section, and the compressor is operable with a low pressure refrigerant or a medium pressure refrigerant.

10. A method of operating a compressor comprising the steps of:

rotating an impeller in a first rotational direction with an impeller motor to draw refrigerant into an inlet of the compressor;

rotating a rotor section downstream of the impeller in a second rotational direction opposite the first rotational direction, wherein the rotor section includes a rotor having a plurality of rotor blades forming at least one row of rotor blades and an outlet of the impeller is immediately upstream of an inlet to the at least one row of rotor blades and the at least one row of blades includes an upstream row of blades having a curvature in the second rotational direction and a downstream row of blades having a curvature in the first rotational direction; and directing the refrigerant from the rotor section to a compressor outlet.

11. The method of claim 10, including turning a direction of the refrigerant in an axial direction with the plurality of rotor blades in the rotor section.

12. The method of claim 10, including driving the impeller with an impeller motor and driving the rotor section with a rotor section motor.

13. The method of claim 10, including driving the impeller with an impeller motor and driving the rotor section with the impeller motor through a transmission.

14. The method of claim 13, including at least one of varying a magnitude of rotation from an output of the impeller motor with the transmission or reversing a direction of rotation of an output of the impeller motor with the transmission.

15. The method of claim 10, wherein the compressor is a mixed flow compressor and the compressor is operable with a low pressure refrigerant or a medium pressure refrigerant.

16. The compressor of claim 1, wherein the at least one row of blades includes a first row of blades and a second row of blades with a downstream end of each of the blades in the first row of blades being upstream of an upstream end of an upstream end of each of the blades in the second row of blades.

17. The compressor of claim 1, including a fluid passage defined between circumferentially adjacent rotor blades of the plurality of rotor blades with the rotor defining a radially inner portion of the fluid passage and the housing defining a radially outer portion of the fluid passage.

18. The method of claim 10, wherein the at least one row of blades includes a first row of blades and a second row of blades with a downstream end of each of the blades in the first row of blades being upstream of an upstream end of an upstream end of each of the blades in the second row of blades.

* * * * *